US009324478B2

(12) United States Patent
Horan et al.

(10) Patent No.: US 9,324,478 B2
(45) **Date of Patent: *Apr. 26, 2016**

(54) HIGH-SPEED DATA CABLE WITH SHIELD CONNECTION

(71) Applicant: Spectra7 Microsystems (Ireland) Limited, County Cork (IE)

(72) Inventors: John Martin Horan, Blackrock (IE); David McGowan, Rostellan (IE); Padraig McDaid, Dooradoyle (IE)

( * ) Notice: Subject to any disclaimer, the term of this patent is extended or adjusted under 35 U.S.C. 154(b) by 31 days.

This patent is subject to a terminal disclaimer.

(21) Appl. No.: 14/014,187

(22) Filed: Aug. 29, 2013

(65) Prior Publication Data

US 2014/0000924 A1 Jan. 2, 2014

Related U.S. Application Data

(63) Continuation of application No. 12/656,994, filed on Feb. 23, 2010, now Pat. No. 8,546,688.

(60) Provisional application No. 61/202,869, filed on Apr. 14, 2009.

(51) Int. Cl.

| | |
|---|---|
| ***H01B 9/00*** | (2006.01) |
| ***H01B 11/10*** | (2006.01) |
| ***H01B 13/22*** | (2006.01) |

(52) U.S. Cl.

CPC ..... *H01B 9/006* (2013.01); *H01B 11/1091* (2013.01); *H01B 13/22* (2013.01); *Y10T 29/49117* (2015.01); *Y10T 29/49169* (2015.01)

(58) Field of Classification Search

USPC ..... 174/36, 74 R, 74 A, 75 B, 76, 77; 333/90, 333/174, 175, 98

See application file for complete search history.

(56) References Cited

U.S. PATENT DOCUMENTS

| | | | | | |
|---|---|---|---|---|---|
| 4,992,060 | A * | 2/1991 | Meyer | 439/620.21 |
| 5,763,825 | A * | 6/1998 | Gilliland | 174/36 |
| 5,831,210 | A * | 11/1998 | Nugent | 174/27 |
| 6,054,649 | A * | 4/2000 | Uchida et al. | 174/36 |
| 6,867,362 | B2 * | 3/2005 | Cherniski et al. | 174/36 |
| 7,173,182 | B2 * | 2/2007 | Katsuyama et al. | 174/36 |
| 7,342,172 | B1 * | 3/2008 | Wang et al. | 174/36 |
| 2008/0078567 | A1 * | 4/2008 | Miller et al. | 174/70 R |

* cited by examiner

*Primary Examiner* — William H Mayo, III

(74) *Attorney, Agent, or Firm* — Trellis IP Law Group, PC

(57) ABSTRACT

A high speed cable with terminating assemblies at the respective ends of the cable includes a ground wire, one or more signal wires, and a conductive layer enclosing the ground wire and the signal wires. The ground wire as well as the signal wires and the conductive layer extend into the terminating assemblies, in each of which corresponding inductive elements are coupled between the conductive layer and the ground wire. In each terminating assembly, the ground wire is shunted to the conductive layer by inductive elements, thus providing added low frequency connectivity in the cable, while at the same time blocking high frequency noise energy that may be present in the ground wire and preventing it from being coupled into, and transmitted through, the conductive layer.

20 Claims, 8 Drawing Sheets

HIGH-SPEED DATA CABLE WITH SHIELD CONNECTION

CROSS REFERENCES TO RELATED APPLICATIONS

This application is a continuation of the following application, U.S. patent application Ser. No. 12/656,994, entitled HIGH SPEED DATA CABLE WITH SHIELD CONNECTION, filed on Feb. 23, 2010, which claims priority from U.S. Provisional Patent Application Ser. No. 61/202,869, filed on Apr. 14, 2009, which are hereby incorporated by reference as if set forth in full in this application for all purposes.

FIELD OF THE INVENTION

The present invention relates to the construction of shielded high speed data cables, which carry signal wires as well as ground and power wires.

BACKGROUND OF THE INVENTION

Some high speed cable standards such as the High-Definition Multimedia Interface HDMI specification (High-Definition Multimedia Interface Specification Version 1.3, published by Hitachi, Ltd., Matsushita Electric Industrial Co., Ltd., Philips Consumer Electronics, International B.V., Silicon Image, Inc., Sony Corporation, Thomson Inc., and Toshiba Corporation, Jun. 22, 2006) have specific limits on the resistance of power and ground lines in the cable. For example, in HDMI cables a limit of 1.8 ohms is specified for the combined resistance of the Ground line and the Power line that provides 5V power and through which power may be provided to embedded circuitry in the cable. Another example of a similar resistance limit is contained in the Universal Serial Bus (USB) 3.0 specification (Universal Serial Bus 3.0 Specification, published by Hewlett-Packard Company, Intel Corporation, Microsoft Corporation, NEC Corporation, ST-NXP Wireless, and Texas Instruments, Revision 1.0, Nov. 12, 2008) according to which the combined resistance of the Power line and the Ground line is limited to 0.4 ohms.

To achieve the specified resistance limits, the conventional approach is to decrease the gauge of the wire, i.e. increase the wire thickness, in accord with increasing cable length.

A problem with the conventional approach of decreasing the gauge of the power and ground wires is that the resulting increase in the wire thicknesses has a direct impact on the cable outer diameter and the flexibility of the cable. This size increase can be significant when active equalization of the data lines is used, which allows higher loss and relatively high gauge (low diameter) wire to be used for the signal lines.

FIG. 1*a* shows a schematic diagram of a shielded high speed cable 100 of the prior art, including a raw cable 102, first and second terminating ends 104.1 and 104.2 at respective first and second ends of the raw cable 102. The raw cable 102 includes wires (conductors), which extend into the first and second terminating ends 104.1 and 104.2, namely a shield 106, a power wire 108, a group of signal wires 110, and a ground wire 112. The shield 106 is an conductive layer, implemented in a form of foil or braid, for example the cable 100 cable can be wrapped in a conductive foil, most often aluminum, or it can be wrapped in a braided mesh of tiny wires. Foil and braid have different characteristics, which accounts for the fact that many cables have both braid and foil as the shield 106.

The raw cable 102 is typically surrounded by an insulating layer (not shown in FIG. 1*a*) made of polyvinyl chloride (PVC) or similar material.

FIG. 1*b* illustrates the raw cable 102 in a schematic cross-sectional view, in which the shield 106 surrounds the power line 108, the group of signal lines 110, and the ground wire 112. The group of signal lines 110 is shown to comprise 6 individual signal wires for illustrative purposes only. The actual number of signal wires varies according to the type of cable (HDMI or USB 3.0 for example). In addition to the signal wires there may also be so-called drain wires (not shown) included, which may be used for impedance control of the signal wires.

The shield 106 of the shielded high speed cable 100 is normally floating in the cable, and may be connected to a metal structure of the equipment to which the cable is connected.

Therefore there is a need in the industry for developing an improved high speed cable, which would avoid or mitigate the shortcomings of the prior art.

SUMMARY OF THE INVENTION

Therefore there is an object of the invention to provide an improved high speed cable with shield connection, which would have superior properties over existing prior art cables.

According to one aspect of the invention, there is provided a high speed cable, having a raw cable having a first end and a second end, and a first and second terminating assemblies at the first and second ends of the raw cable respectively, the high speed cable comprising:

a ground wire;

a signal wire; and a conductive layer enclosing the ground wire and the signal wire;

the ground wire, the signal wire and the conductive layer extending between the first and second ends and extending into the first and second terminating ends; and first and second inductive elements coupled between the conductive layer and the ground wire in the first and second terminating assemblies respectively, thus shunting the ground wire in said terminating assemblies.

In the embodiments of the invention, inductance values of the first and second inductive elements are substantially the same. Alternatively, the inductance values of the first and second inductive elements may be different. The inductance values of the inductive elements need to be selected so as to provide resistance, which is noticeably greater than resistance of the ground wire at electromagnetic frequencies of interest.

Conveniently, the first and second inductive elements comprise one or more of the following:

an inductor;

a ferrite bead.

In the embodiments of the invention, the first and second inductive elements have inductance values selected from the following:

60 nH;

from about 30 nH to about 300 nH.

The first and second inductors can be formed on a printed circuit board (PCB) in one of the following ways:

mounted on the PCB;

implemented directly as tracks on the PCB.

In the high speed cable described above, the conductive layer is a shield, comprising one of the following:

a conductive braid;

a conductive foil;

a conductive braid and a conductive foil.

The high speed cable further comprises a power wire enclosed by the conductive layer.

In different implementations of the high speed cable, the power wire may have a diameter, which is larger than a diameter of the ground wire. Alternatively, the power wire may have a diameter, which is substantially the same as a diameter of the ground wire. A diameter of the signal wire may be substantially the same as the diameter of the ground wire.

In one of the embodiments describing the high speed cable,
- the power wire is disposed approximately in a center of the conductive layer;
- the ground wire comprises two or more ground wires;
- the signal wire comprises two or more signal wires; and
- the signal wires is disposed in a space between the conductive layer and the power conductor and separated by the ground wires.

In the high speed cable described above, a diameter of the power wire and a diameter of the ground wire are specified approximately by American Wire Gauge (AWG) 22 and 36 respectively.

In one of the embodiments of the invention, the high speed cable has signal wires, which include one or more of the following:
- a shielded twisted pair (STP);
- an unshielded twisted pair (UTP).

The high speed cable of the embodiments of the invention includes a Universal Serial Bus (USB) 3.0 cable; and a High-Definition Multimedia Interface (HDMI) cable.

In yet another embodiment of the invention, the signal wire of the cable is shielded in a coaxial structure having a shield, and wherein the shield of the coaxial structure is used as the ground wire; or a power wire.

In one more embodiment of the invention, the high speed cable may further comprise an inner conductive layer within the conductive layer, which is insulated from the conductive layer, wherein the inner conductive layer is used as a power wire.

In the cable as described above, the signal wire comprises:
- at least one shielded twisted pair (STP); and
- at least one insulated signal wire shielded in an individual coaxial structure.

According to another aspect of the invention, there is provided a method for forming a cable having first and second ends, the cable having a ground wire and a conductive layer enclosing the ground wire, the ground wire and the conductive layer extending between the first and second ends, the method comprising:
- reducing resistance of the ground wire in the cable, comprising:
  - coupling the ground wire and the conductive layer via first and second inductive elements at the first and second ends respectively, thereby shunting the ground wire.

According to yet another aspect of the invention, there is provided a cable having first and second ends, the cable comprising:
- a ground wire;
- a conductive layer enclosing the ground wire;
- the ground wire and the conductive layer extending between the first and second ends of the cable;
- first and second inductive elements coupled between the conductive layers and the ground wire at the first and second ends respectively, thereby shunting the ground wire.

In the cable described above, inductance values of the first and second inductive elements may be the same, or alternatively the inductance values may be different as long as they are selected so as to provide resistance, which is noticeably greater than resistance of the ground wire at electromagnetic frequencies of interest.

Thus, an improved high speed data cable with shield connection has been provided.

BRIEF DESCRIPTION OF THE DRAWINGS

Embodiments of the invention will now be described, by way of example, with reference to the accompanying drawings in which.

DETAILED DESCRIPTION OF THE EMBODIMENTS OF THE INVENTION

Embodiments of the present invention describe a high speed cable, in which the cable shield is used as a direct current (DC) path to reduce the combined resistance of the power and ground wires (conductors), as measured between the ends of the cable.

Figure 1A:
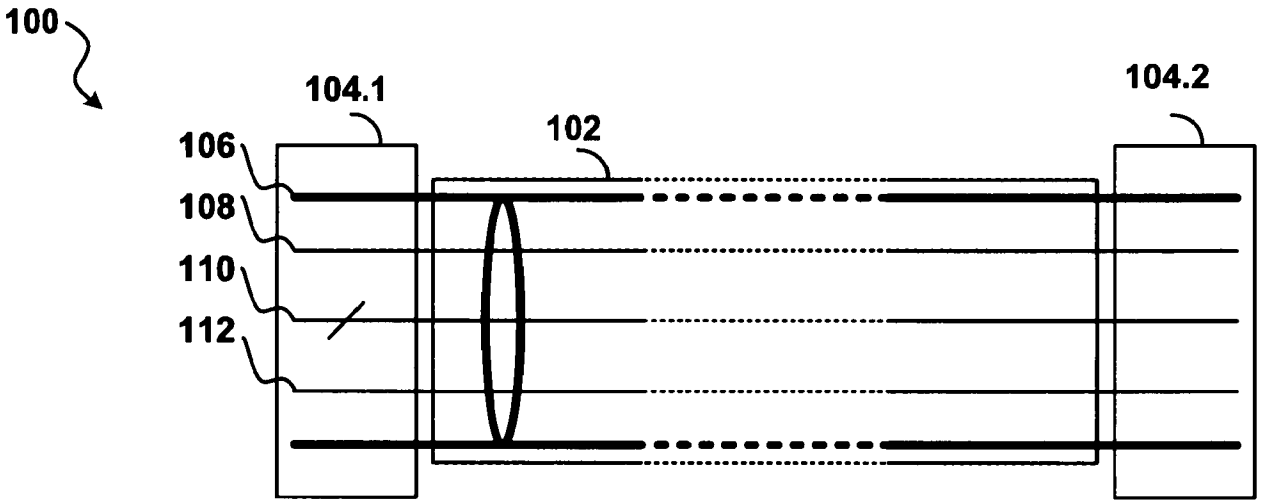
FIG. 1a (prior art)
FIG. 1*a* shows a schematic diagram of a shielded high speed cable 100 of the prior art, including a raw cable 102.
Figure 1B:
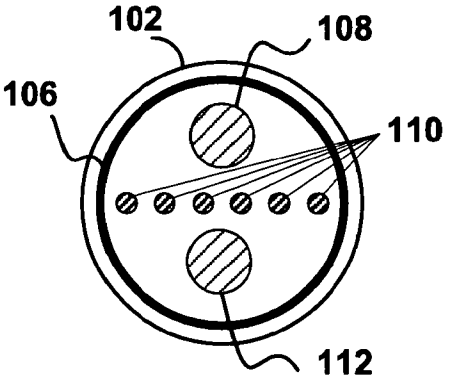
FIG. 1b (prior art)
FIG. 1*b* illustrates the raw cable 102 of FIG. 1*a* in a schematic cross-sectional view.
Figure 2A:
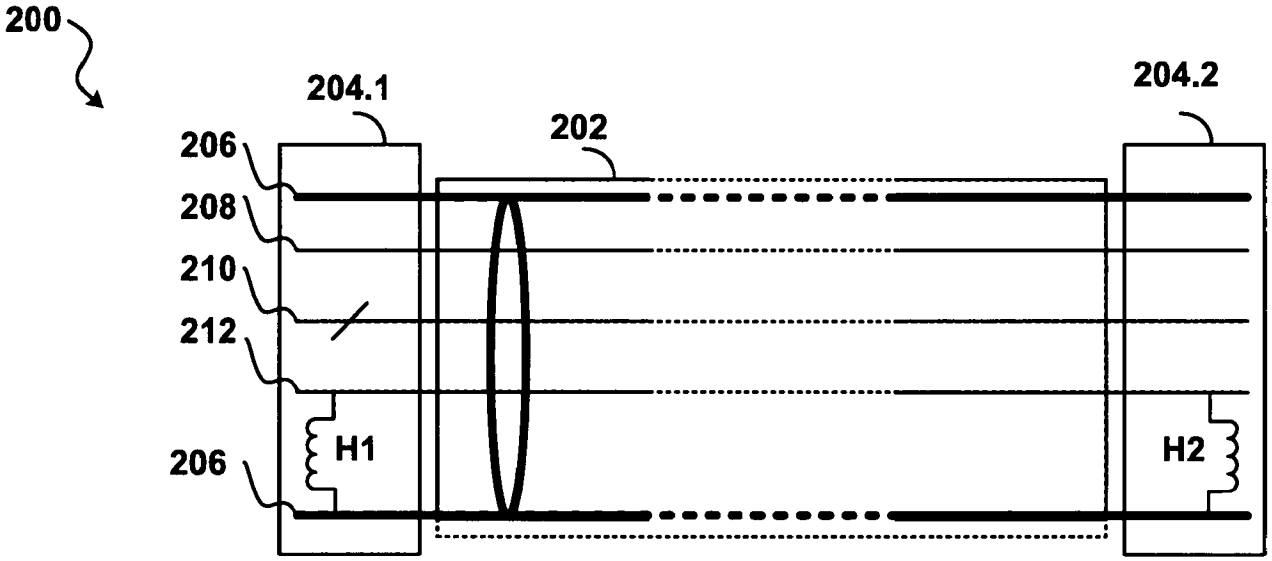
FIG. 2*a* shows a schematic diagram of an improved shielded high speed cable 200 according to one embodiment of the invention, including an improved raw cable 202.

FIG. 2*a* shows a schematic diagram of an improved shielded high speed cable 200 according to one embodiment of the invention, including an improved raw cable 202 having improved first and second terminating ends, or terminating assemblies, 204.1 and 204.2 at respective first and second ends of the improved raw cable 202. Similar to the shielded high speed cable 100 of FIG. 1*a*, the improved raw cable 202 includes wires (conductors), which extend into the terminating ends 204.1 and 204.2, namely a shield (conductive layer) 206, which may be foil and/or braid, a power wire 208, a group of signal wires 210, and a thinner ground wire 212. In addition, the improved terminating ends 204.1 and 204.2 include respective first and second inductive elements, implemented as inductors, and labeled with reference numerals H1 and H2 in FIG. 2*a*, where the first inductor H1 is connected between the thinner ground wire 212 and the shield 206 within the improved first terminating end 204.1, and the second inductor H2 is connected between the thinner ground wire 212 and the shield 206 within the second improved terminating end 204.2. The improved raw cable 202 is typically surrounded by an insulating layer (not shown in FIG. 2*a*) made of polyvinyl chloride (PVC) or similar material. The inductors H1 and H2 may be components mounted on small printed circuit boards (PCBs) in the improved terminating ends 204.1 and 204.2, or may be implemented directly as tracks on the PCBs. Such PCBs may be provided exclusively for the inductors H1 and H2, or already exist for other purposes such as active circuitry in one or both of the improved terminating ends 204.1 and 204.2.

Through the inductors H1 and H2, the thinner ground wire 212 is effectively shunted by the shield 206 providing a combined lower direct current (DC) resistance between the two terminating ends 204 than would a ground wire alone. This allows the thinner ground wire 212 to be constructed from a much thinner wire compared to the ground wire 112 of the shielded high speed cable 100 of the prior art.

The inductors H1 and H2 preferably have a negligibly low resistance, while their inductance may be typically be in the range of about 30-300 nH. If the thinner ground wire 212 were connected to the shield 206 directly without inductors H1 and H2, this would allow most of the high frequency noise current in the ground wire 212 to pass through the shield 206, which would then radiate electro-magnetic interference (EMI) and thus create problems with high frequency EMI. The high frequency noise current in the ground wire 212 could, for example, be caused by any active circuitry that obtain their power from the power wire 208 and return through the ground wire 212. The inductors H1 and H2 are designed to prevent the high frequency noise current from reaching the shield 206. The inductors H1 and H2 thus allow the shield 206 to decrease the low frequency resistance of the improved raw cable 202, and allow power to pass though the cable shield 206, but the inductors H1 and H2 will stop any high frequency energy from entering the shield 206 and stop the high frequency unwanted EMI.

Figure 2B:
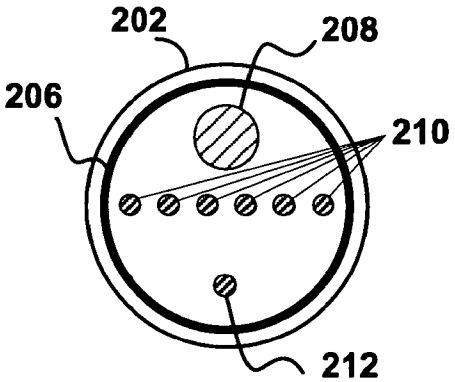
FIG. 2*b* illustrates the improved raw cable 202 of FIG. 2*a* in a schematic cross-sectional view.

FIG. 2*b* illustrates the improved raw cable 202 in a schematic cross-sectional view, in which the shield 206 surrounds the power wire 208, the group of signal lines 210, and the thinner ground conductor 212. Again, the group of signal lines 210 is shown to comprise 6 individual signal wires for illustrative purposes only.

Note the relative thickness of the thinner ground wire 212 compared to the power wire 208.

Following a description of a proposed cross section of a USB cable according to the prior art, specific example configurations for the improved raw cable 202 are described, according to embodiments of the invention.

Figure 3:
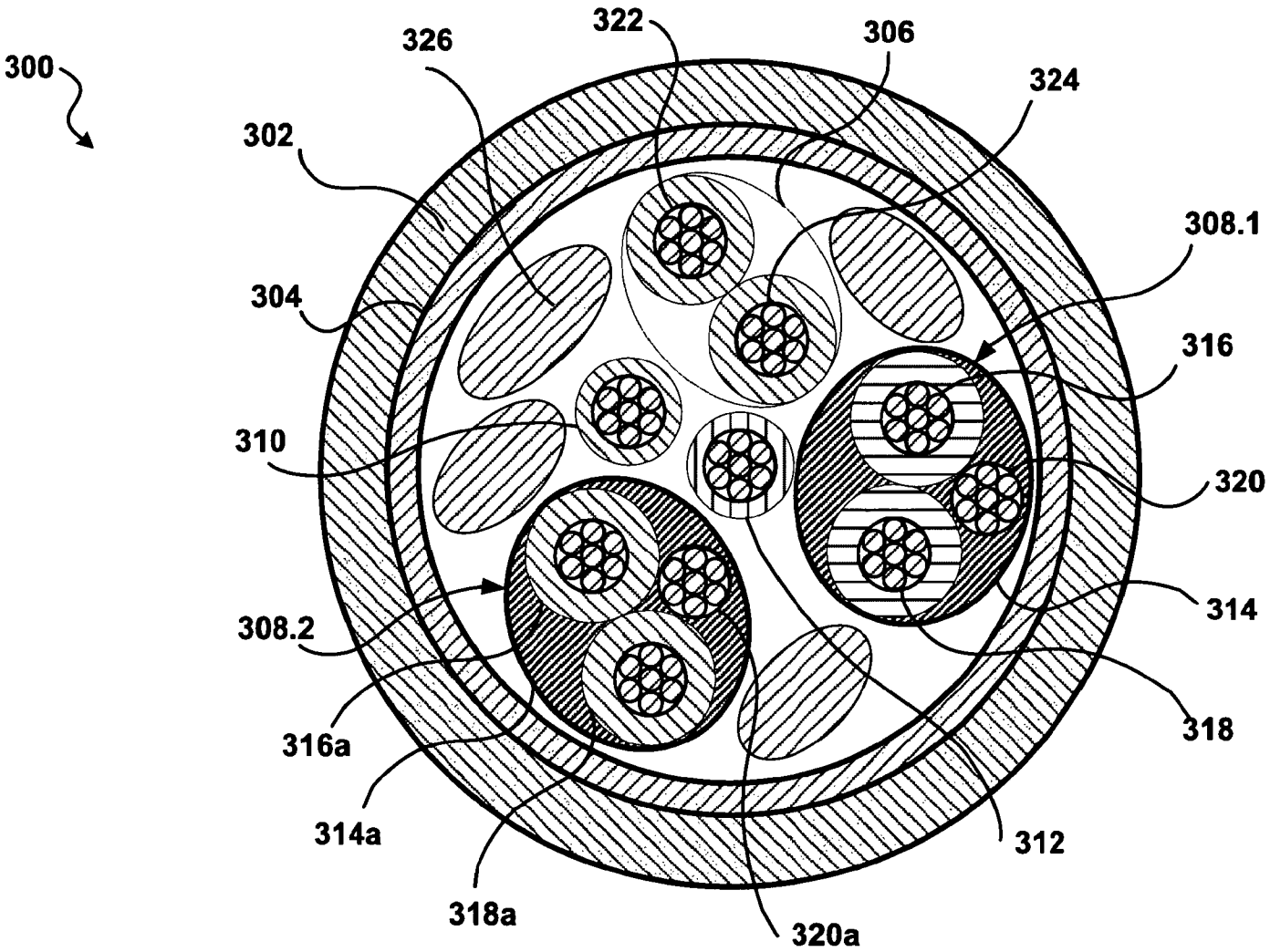
FIG. 3 (prior art)
FIG. 3 shows an example of the construction of a standard USB 3.0 cable 300 of the prior art.

FIG. 3 shows an example of the construction of a standard USB 3.0 cable 300 of the prior art in a cross-sectional view. The standard USB 3.0 cable 300 is described in a white paper "SuperSpeed USB 3.0 Specification Revolutionizes an Established Standard", November 2008 by Sanjiv Kumar of Denali Software Inc., which has been reported in the Information Disclosure Statement submitted by the applicants. The standard USB 3.0 cable 300 includes a jacket 302 outside of a surrounding shield (braid) 304 which encloses: an unshielded twisted pair (UTP) signal pair 306; two shielded differential pairs (SDP), signal pair 308.1 and 308.2; a power wire 310; and a ground wire 312. The SDP signal pair 308.1 is enclosed in an individual foil shield 314 and includes two data signal wires 316 and 318, and a drain wire 320. The wires are shown in cross-section as stranded wires, although the wires could equally be solid. The construction of the second SDP signal pair 308.2 is similar to that of the first SDP signal pair 308.1, namely the SDP signal pair 308.2 is enclosed in an individual foil shield 314*a* and includes two data signal wires 316*a* and 318*a*, and a drain wire 320*a*. The UTP signal pair 306 includes two data signal wires 322 and 324, but no individual shield. The surrounding shield (braid) 304 may also enclose optional filler strands 326 for the purpose of achieving an approximately circular shape of the cable cross section.

Figure 4:
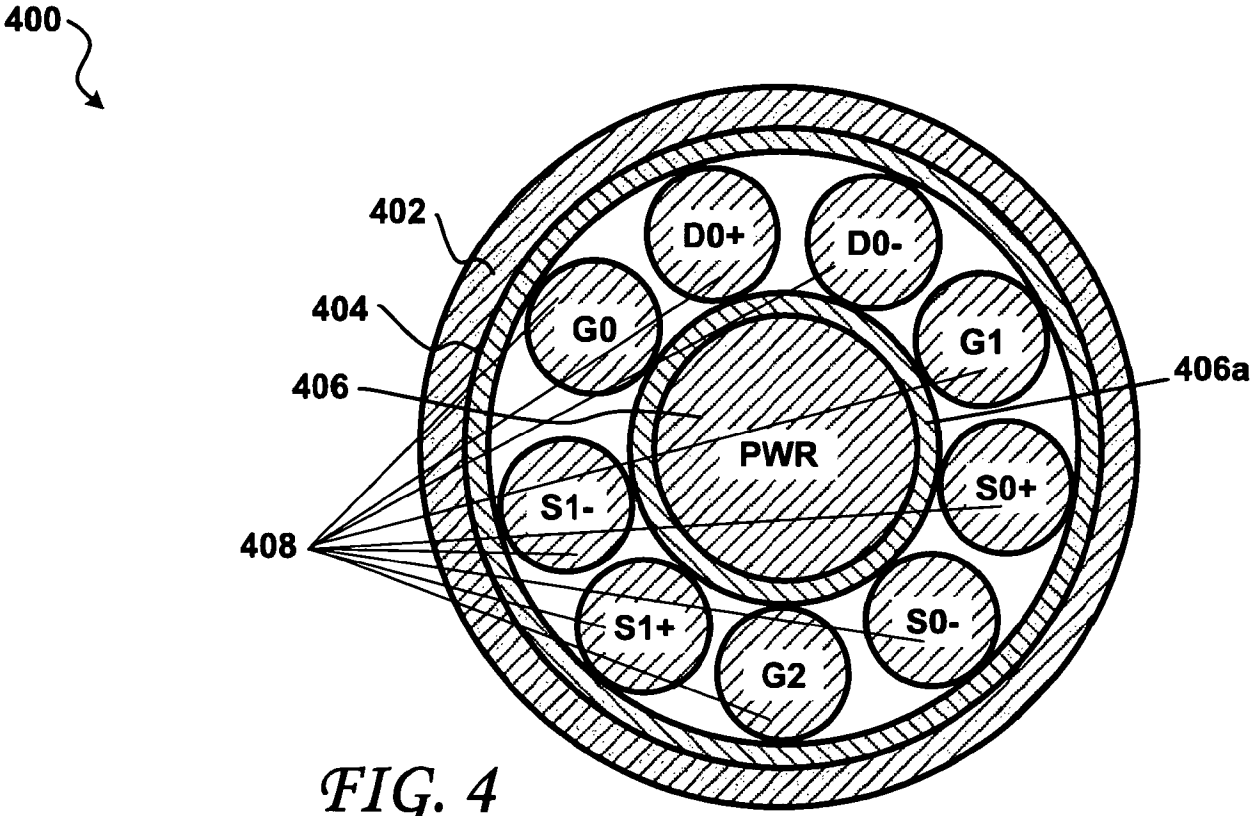
FIG. 4 shows a cross-sectional view of a raw high speed USB cable 400 according to an embodiment of the invention.

FIG. 4 shows a cross-sectional view of a raw high speed USB cable 400 according to an embodiment of the invention, which shows a concentric ring arrangement of signal and ground wires. The high speed cable 400 includes, starting from the outside of the cable, a concentric insulating outer coating 402; a concentric conductive layer 404 which may comprise a braid as well as a foil; a central power wire 406 with a foil coating 406*a*; and insulated wires 408 in the space between the concentric conductive layer 404 and the central power wire 406. For illustration purposes, nine insulating wires have been shown as follows: a pair of insulated data signal wires D0+ and D0−; a first pair of insulated super-speed data signal wires S0+ and S0−; a second pair of insulated super-speed data signal wires S1+ and S1−; and three insulated ground wires, or ground conductors G0, G1, and G2, which are collectively labeled with reference numeral 450 on FIG. 5 below.

The size of the central power wire 406 is preferably approximately American Wire Gage (AWG) 22, while the size of each of the insulated data signal wires (D0+, D0−, S0+, S0−, S1+, S1) may then be approximately Awg 36, and the Ground wires (G0, G1, and G2) are uninsulated Awg 30 wires. This arrangement allows the nine insulated wires 408 located inside of the concentric conductive layer 404 to be deposed evenly around the thicker central power wire 406 such as to fill the available space without the need for additional filler elements. Each of the pairs of insulated data signal wires (D0+, D0−) and insulated super-speed data signal wires (S0+, S0−, S1+, S1−) are deposed adjacent to each other, while the insulated ground wires (G0, G1, G2) are interposed between the pairs such as to provide shields between the data signal wire pairs. The insulation of the nine insulated wires 408 is chosen to give each data signal wire pair an impedance Z0 of 50 ohms.

Other wire sizes may be selected such that the nine additional insulated wires 408 fit neatly around the central power wire 406, and within the concentric conductive layer 404, comprising a braid or a foil, or a combination thereof.

Figure 5:
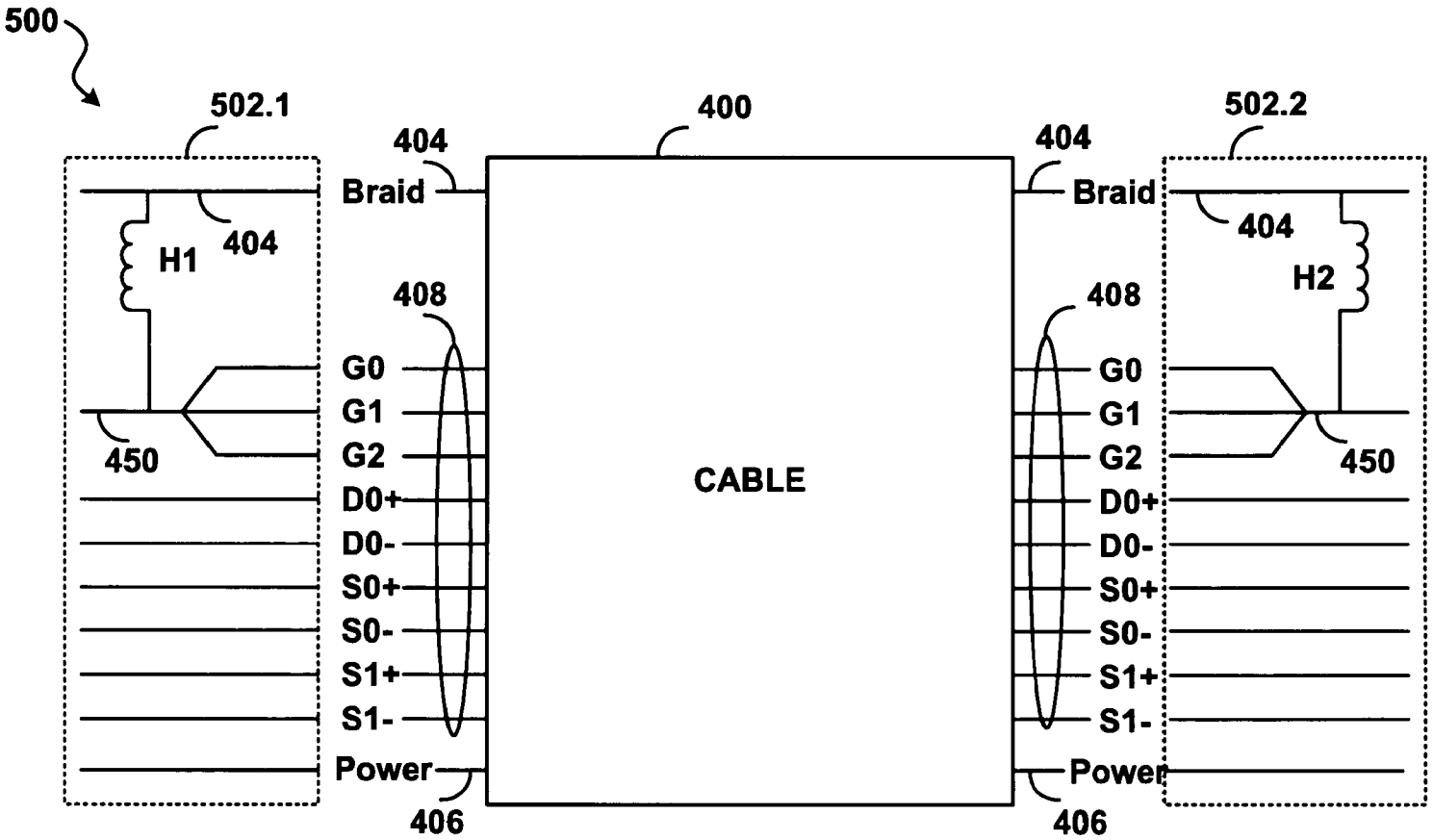
FIG. 5 shows a schematic diagram of an improved shielded high speed USB cable 500 including the raw high speed USB cable 400 of FIG. 4.

FIG. 5 shows a schematic view of a high speed USB cable 500 including the raw high speed USB cable (raw cable) 400 of FIG. 4 connected to terminating assemblies 502.1 and 502.2 at the ends of the raw cable 400. In the terminating assemblies 502.1 and 502.2 the concentric conductive layer 404 of the raw cable 400 is connected to the ground wires 450 through inductors H1 and H2 respectively in the same manner as described in FIG. 2*a*. The resistance of the power-ground loop 450-H1-404 is low as a result of the heavy gauge of the central power wire 406 combined with the uninsulated ground wires 450 (G0, G1, and G2) that are shunted by the concentric conductive layer 404 (the braid and/or foil) through the inductors H1 and H2 in the terminating assemblies 502.1 and 502.2 respectively, at the same time as EMI problems are avoided (as described in FIGS. 2*a* and 2*b*).

In the following FIGS. 6, 7, and 8, alternative implementations of the raw cable are shown, each of them to be used in conjunction with cable terminating assemblies, in which inductive elements (for example, H1 and H2 of FIG. 5) are used to couple the one or more ground wires of the respective cable to an outer concentric layer of the cable, the outer concentric layer being a conductive braid or foil or combination thereof.

Figure 6:
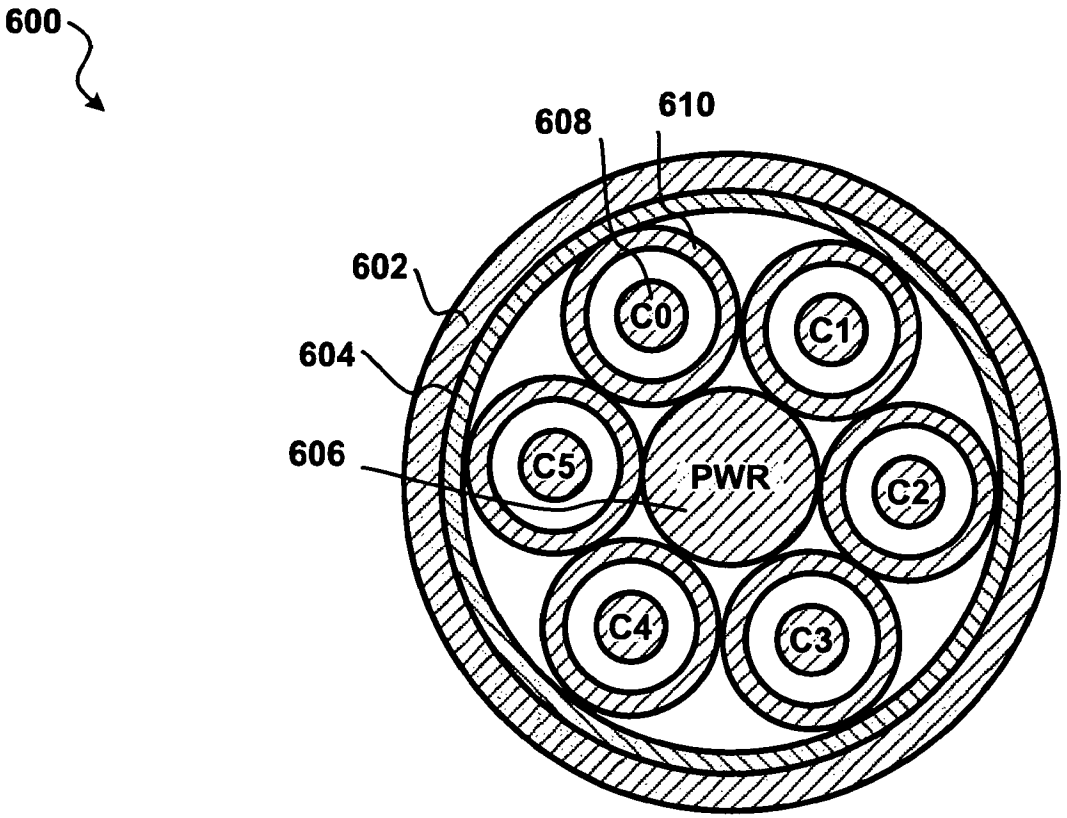
FIG. 6 shows a cross-sectional view of a raw all-coax cable 600 according to another embodiment of the invention.

FIG. 6 shows a cross-sectional view of a raw all-coax cable 600 according to another embodiment of the invention, comprising a concentric insulating outer coating 602; a concentric conductive layer 604, which may comprise a braid as well as a foil; a central power wire 606; and six insulated coax lines C0 to C5, wherein the number six has been chosen to satisfy USD 3.0 specification, each of which comprises a core conductor 608 and a shield 610. The core conductors 608 of the six coax lines C0 to C5 provide conductivity for the six data signals (D0+, D0−, S0+, S0−, S1+, S1− of FIG. 4). The shields 610 of the six insulated coax lines C0 to C5 may be used individually as ground conductors (wires), but some of the shields 610 may optionally also be used as power conductors (wires). Connections between the concentric conductive layer 604 and any of the shields 610 that are used as ground conductors are again provided through inductors H1 and H2 in the terminating assemblies analogous to the arrangement shown in FIG. 5 for EMI protection.

Additional insulated wires (not shown), preferably, with the same diameter as the six insulated coax lines C0 to C5, can be added around the central power wire 606. This would allow an increase in the diameter of the central power wire 606, while maintaining the rotational symmetry. It is also contemplated that additional insulated wires may have a diameter, which is different from the diameter of the six insulated wires.

These additional insulated wires can then be used as ground conductors or power conductors. Connections between the concentric conductive layer 604 and any of the shields of the insulating wires that are used as ground conductors are again provided through inductors H1 and H2 in the terminating assemblies analogous to the arrangement shown in FIG. 5.

Thus, reducing the end to end resistance of the ground conductor is achieved.

Figure 7:
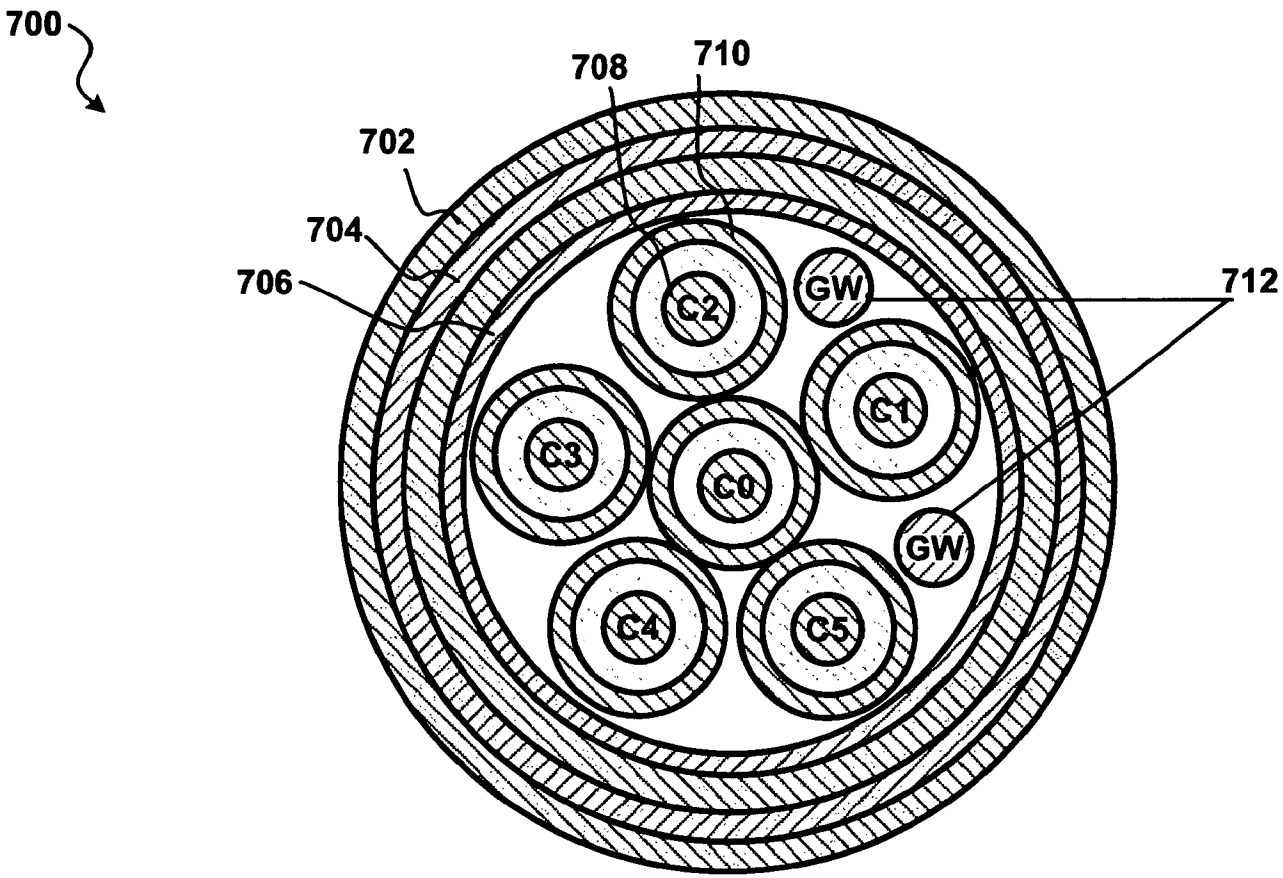
FIG. 7 shows a cross-sectional view a raw double-coax cable 700 according to yet another embodiment of the invention.

FIG. 7 shows a cross-sectional view of a raw double-coax cable 700 according to yet another embodiment of the invention, comprising a concentric insulating outer coating 702; a concentric outer conductive layer 704, which may comprise a braid as well as a foil; a concentric inner conductive layer 706, which may also comprise a braid as well as a foil; six insulated coax lines C0 to C5, wherein the number six has been chosen to satisfy USB 3.0 specification, each of which comprises a core conductor 708 and a shield 710, and one or more ground wires 712 (GW). The raw double-coax cable 700 is similar to the raw all-coax cable 600 of FIG. 6, however the power conducting function of the central power wire 606 of the raw all-coax cable 600 is replaced in the raw double-coax cable 700 by the concentric inner conductive layer 706. The concentric outer conductive layer 704 of the raw double-coax cable 700 is connected to at least one ground wire 712 through inductors H1 and H2 in the terminating assemblies (not shown), in the same manner as described earlier, analogous to the arrangement shown in FIG. 5 for EMI protection.

The arrangement shown in FIG. 7 allows for flexibility in the choice of diameters for the coax lines C0 to C5. For example, in the case of USB 3.0, the coax lines C0 and C1 may be used to carry the standard high-speed data signals and have a smaller diameter than the coax lines C2 to C5 which would be used to carry the standard super-speed data signals.

Figure 8:
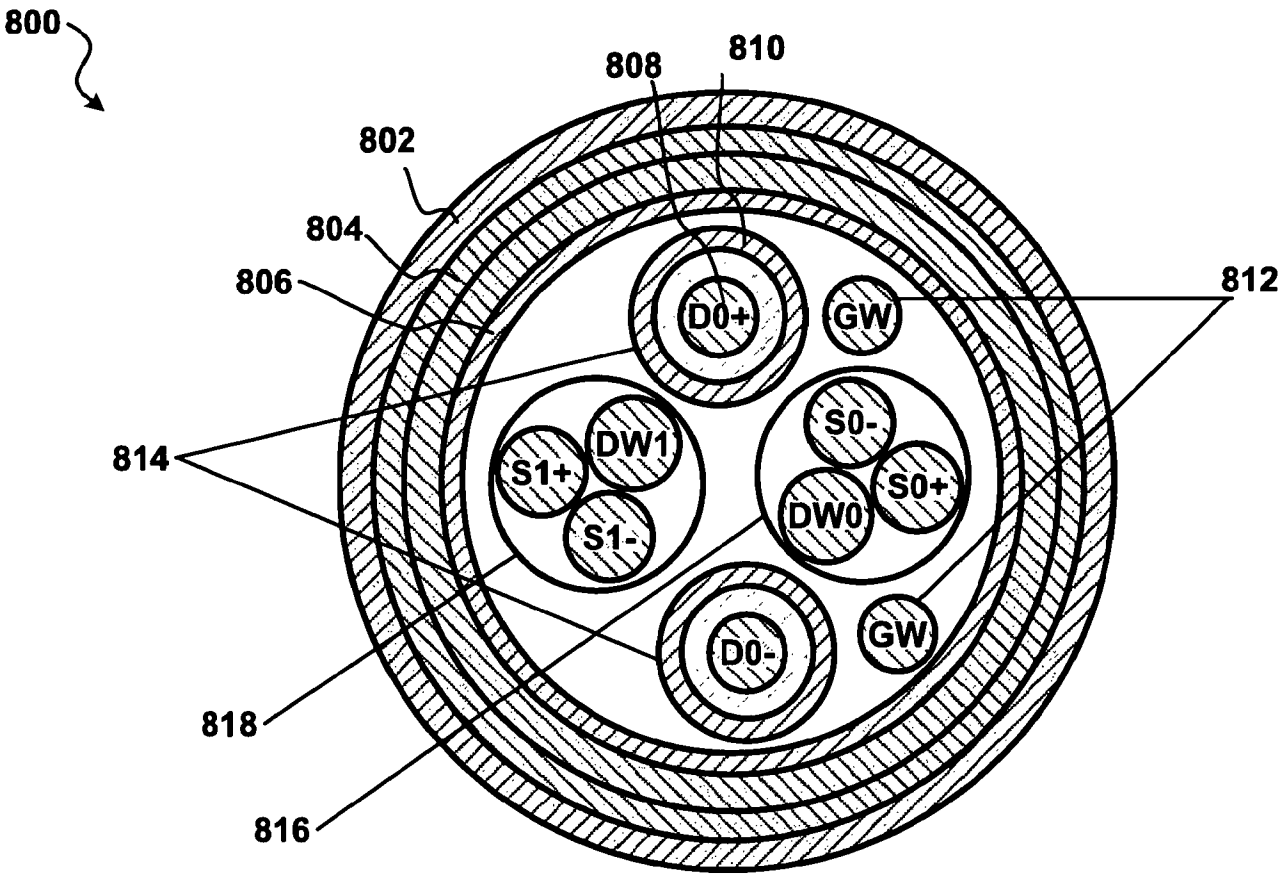
FIG. 8 shows a mixed construction raw double-coax cable 800 according to a further embodiment of the invention.

FIG. 8 shows a mixed construction raw double-coax cable 800 according to a further embodiment of the invention, comprising a concentric insulating outer coating 802; a concentric outer conductive layer 804, which may comprise a braid as well as a foil; a concentric inner conductive layer 806, which may also comprise a braid as well as a foil; one ore more ground wires (GW) 812; two insulated coax lines 814, which may carry high-speed data signals, for example, the USB 3 standard signals D0+ and D0− respectively; and two wire bundles 816 and 818 which may carry super-speed data signals, for example, the USB 3.0 standard signals S0+ and S0−, and S1− and S1+. The wire bundles 816 and 818 further include drain wires DW0 and DW1 respectively. The inner conductive layer 806 of FIG. 8 can be used as a power conductor (wire) similar to the inner conductive layer 706 of FIG. 7 described above.

It is understood that other types of cables may include only one of the wire bundles 816 or 818 and not necessarily both of them.

Common to all variations of the improved raw cable of the embodiments of the invention, i.e. the improved raw cable 202, the raw high speed USB cable 400, the high speed USB cable 500, the raw all-coax cable 600, the raw double-coax cable 700, and the mixed construction raw double-coax cable 800, is a terminating arrangement exemplified by the first and second terminating ends 204.1 and 204.2, which has been described in detail with regard to FIG. 2, and similar terminating end 502.1 and 502.2 described in detail with regard to FIG. 5. The terminating ends (assemblies) 204.1, 204.2, and 502.1, 502.2, have in common inductive elements (H1, H2), which provide a direct current (DC) path between the ground wire (206, 450), and the (outer) conductive layer (204 or 404) of the raw cable, thus reducing the ground resistance through the cable as the internal ground wires are shunted by the braid, while avoiding EMI problems due to the inductors blocking high-frequency noise that may be carried in the ground wires from reaching the conductive layer (braid and/or foil), which continues to act as a shield around the whole cable.

This then results in the ability to use much thinner wire gauges for the ground wires. Similarly, the use of an inner conductive layer 706 in the raw double-coax cable 700, and an inner conductive layer 806 in the mixed construction raw double-coax cable 800 as a power conductor results in the avoidance of a power wire altogether.

All these measures are designed to contribute to making a thinner, lighter, and more flexible cable.

Thus, an improved high speed cable with shield connection has been provided.

Various modification and variations can be made to the embodiments of the invention described above.

For example, inductive elements H1 and H2 can be implemented as inductive (ferrite) beads instead of inductors, or they can be implemented as other suitable electrical/electronic elements possessing inductive properties.

Although it is preferred to have values H1 and H2 of the inductive elements to be approximately equal, it is contemplated that inductive elements H1 and H2 may have different inductive values, provided they result in a resistance, which is significantly greater, or at least noticeably greater, than the resistance of the thinner ground wire (for example, thinner ground wire 212) at EMI frequencies of interest.

Geometrical arrangements of wires and coaxial structures inside the cable, relative sizes of wires and coaxial structures inside the cable are shown for illustrative purposes only, and can be changed as required.

Although various exemplary embodiments of the invention have been disclosed, it should be apparent to those skilled in the art that various changes and modifications can be made which will achieve some of the advantages of the invention without departing from the true scope of the invention.

A person understanding this invention may now conceive of alternative structures and embodiments or variations of the above all of which are intended to fall within the scope of the invention as defined in the claims that follow.

What is claimed is:

1. A cable comprising:

a raw cable having first and second cable ends, the raw cable comprising a signal wire, a ground wire, and a conductive layer enclosing the ground wire and the signal wire;

a first inductive element coupled between the conductive layer and the ground wire at the first cable end; and a second inductive element coupled between the conductive layer and the ground wire at the second cable end.

2. The cable of claim 1, wherein the first and second inductive elements provide conductive paths in parallel with the ground wire to shunt DC and low-frequency signals to ground at the first and second cable ends.

3. The cable of claim 1, wherein inductance values of the first and second inductive elements are substantially the same.

4. The cable of claim 1, wherein the first inductive element is selected so as to provide a first resistance that is greater than a resistance of the ground wire at an electromagnetic frequency of interest.

5. The cable of claim 1, wherein the first and second inductive elements include at least one of the following:

an inductor; and a ferrite bead.

6. The cable of claim 1, wherein the first and second inductive elements have inductance values selected from following:

60 nH;

from about 30 nH to about 300 nH.

7. The cable of claim 1, wherein at least one of the first and second inductive elements includes an inductor formed on a printed circuit board (PCB) in one of the following ways:

mounted on the PCB;

implemented directly as tracks on the PCB.

8. The cable of claim 1, wherein the conductive layer is a shield comprising at least on one of the following:

a conductive braid; and a conductive foil.

9. The cable of claim 1, wherein the raw cable further includes a power wire enclosed by the conductive layer.

10. The cable of claim 9, wherein:

the power wire has a diameter that is substantially the same or larger than a diameter of the ground wire.

11. The cable of claim 9, wherein:

the power wire is disposed approximately in a center of the raw cable.

12. The cable of claim 9, wherein:

the ground wire comprises two or more ground wires;

the signal wire comprises two or more signal wires; and the signal wires are located in a space between the conductive layer and the power wire.

13. The cable of claim 12, wherein the signal wires are circumferentially arranged around the power conductor and separated by the ground wires.

14. The cable of claim 9, wherein a diameter of the signal wire is substantially the same as the diameter of the ground wire.

15. The cable of claim 1, wherein the raw cable includes at least two signal wires comprising one or more of the following:

a shielded twisted pair (STP);

an unshielded twisted pair (UTP).

16. The cable of claim 1, the cable being one of the following:

a Universal Serial Bus (USB) 3.0 cable;

a High-Definition Multimedia Interface (HDMI) cable.

17. The cable of claim 1, wherein the signal wire is shielded in a coaxial structure having a shield.

18. The cable of claim 17, further comprising an inner conductive layer enclosed by and insulated from the conductive layer, wherein the inner conductive layer includes a power wire.

19. A method for forming a cable including a raw cable having first and second cable ends, the raw cable comprising a signal wire, a ground wire, and a conductive layer enclosing the ground wire and the signal wire, the method comprising:

reducing the resistance of the ground wire in the raw cable, comprising:

electrically coupling a first inductive element with the conductive layer and the ground wire at the first cable end; and electrically coupling a second inductive element with the conductive layer and the ground wire at the second cable end.

20. The method of claim 19, wherein the first and second inductive elements provide conductive paths in parallel with the ground wire to shunt DC and low-frequency signals to ground at the first and second cable ends; and wherein the first and second inductive elements provide resistances greater than a resistance of the ground wire at an electromagnetic frequency of interest.

* * * * *